United States Patent [19]

Piccini

[11] 4,325,548

[45] Apr. 20, 1982

[54] KICKING DEVICE

[76] Inventor: Silvio D. Piccini, 13620 SW. 74th Ct., Miami, Fla. 33158

[21] Appl. No.: 117,538

[22] Filed: Feb. 1, 1980

[51] Int. Cl.[3] ..... A63B 69/00; A63B 23/04; A63B 21/12

[52] U.S. Cl. ..... 273/55 B; 272/136; 272/142

[58] Field of Search ..... 273/55 B, DIG. 5, DIG. 8; 128/69, 25, 71; 272/900, 96, 72, 70.2, 128, 116, 119, 133, 117, 118, 138, 144, 142, 135, 136, 137, 140, 131

[56] References Cited

U.S. PATENT DOCUMENTS

| | | | |
|---|---|---|---|
| 418,257 | 12/1889 | Whitely | 272/136 |
| 3,162,442 | 12/1964 | Karlik | 272/136 |
| 3,972,238 | 8/1976 | Thatcher | 273/55 R |
| 4,026,548 | 5/1977 | Birdwell | 272/136 |

FOREIGN PATENT DOCUMENTS

| | | | |
|---|---|---|---|
| 377585 | 5/1907 | France | 272/136 |
| 1149767 | 12/1957 | France | 272/136 |
| 26180 | of 1905 | United Kingdom | 272/136 |

*Primary Examiner*—Richard C. Pinkham
*Assistant Examiner*—T. Brown
*Attorney, Agent, or Firm*—Jack E. Dominik

[57] ABSTRACT

The method shown contemplates a restraining element applied to the kicking foot of the player which, in turn, is secured to an elastic strap which is anchored at a remote position. The player then positions the pivot foot firmly on the ground or floor, and exercises the kicking leg by bending the knee with the toes downwardly and moving the knee to a position where the leg is substantially straight, and the ankle to a position where the foot is substantially perpendicular to the straight leg at the point when the foot is parallel with the floor or ground. Modifications of the method include starting from the position with the foot parallel with the ground and moving the leg forwardly with the toes extending progressively downwardly against the tension of the strap and then retracting through the same steps.

The device discloses an elastic band for circumferentially engaging the ankle of the player with an elastomeric strap secured at a rear portion of the band adjacent the Achilles heel of the player, and anchoring the strap at a position remote from the point where it is attached to the ankle band. Desirably a clip with a ring is secured at the rear portion of the strap so that the same can be attached to a tree, post, or other anchor portion adjacent the ground or floor.

2 Claims, 10 Drawing Figures

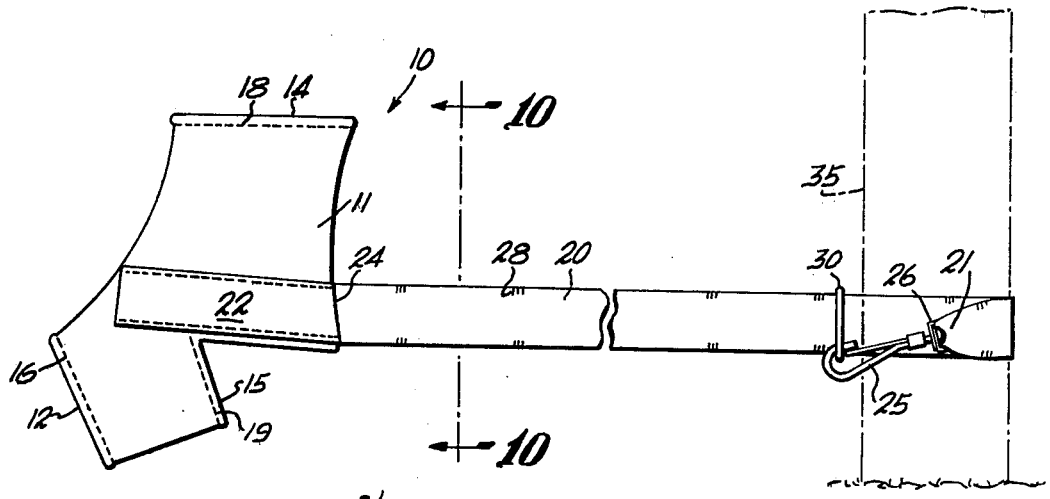
Fig. 8
Fig. 9
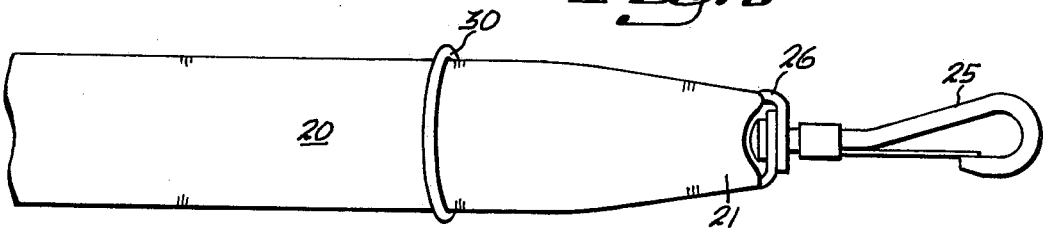
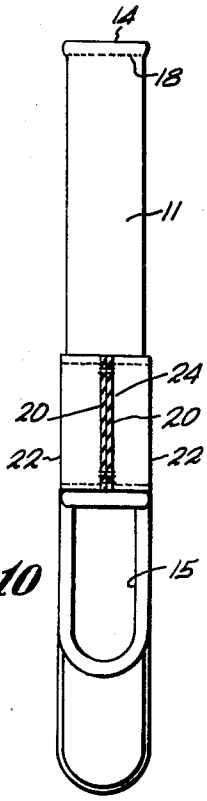
Fig. 10

KICKING DEVICE

FIELD OF INVENTION

The present invention is directed to a kicking device and method. The art is classified in class 273 sub-class 55B and class 272 sub-classes 80, 82, 83, 125, 137 and 141, and elsewhere.

THE PRIOR ART

The Prior Art is exemplified by U.S. Pat. No. 1,905,352 entitled "Punting Machine" which is a large complicated device utilizing a plurality of sequentially engaged loads. Other patents such as U.S. Pat. Nos. 3,749,400; 1,734,238: and 2,340,66 are leg exercising devices, many of which are designed for use on the prone or seated position. As to the nonpatented devices, leg weights are employed such as small dumbbells layed over the ankle, as well as ankle weights for lifting.

In the various methods for strengthening the kicking leg running is employed, kicking of the ball, whether football or soccer ball is repeated generally outdoors. Running in shallow water is often encouraged.

The problem with all of the devices disclosed in a patent literature, as well as the methods set forth above, is that they require a special environment, and often times do not adequately and precisely control the particular muscles and sequence to strengthen the leg for proper kicking.

As pointed out in The Athletic Journal, Volume 60, issued Sept. 19, 1979 by Richard Salvino "Dynamics of Punting" when a moving mass collides with a stationary object, the moving mass tends to retain its speed. The lighter object, such as a football or soccer ball which is at rest, may acquire as much as double the speed as the original moving mass or foot. It is therefore important for the foot to have as much speed as possible at the point of contact with the ball so that the gain in the speed of the ball will be increased substantially, resulting in maximum distance of travel by the ball.

To acquire the maximum transfer of foot speed to the ball, the foot and the ankle must be as rigid as possible. This rigidity, coupled with a conditioned speed and strength, permits the kicker to often times double the velocity of the ball and thereby maximize the kicking distance and, depending upon the dexterity of the player, also the accuracy of the direction and distance of the ball.

SUMMARY

The present invention as to the method contemplates a restraining element applied to the kicking foot of the player which, in turn, is secured to an elastic strap which is anchored at a remote position. The player then positions the pivot foot firmly on the ground or floor, and exercises the kicking leg by bending the knee with the toes downwardly and moving the knee to a position where the leg is substantially straight, and the ankle to a position where the foot is substantially perpendicular to the straight leg at the point when the foot is parallel with the floor or ground. Modifications of the method include starting from the position with the foot parallel with the ground and moving the leg forwardly with the toes extending progressively downwardly against the tension of the strap and then retracting through the same steps. Optionally, to increase the tension and the load on the player, the player can continue with a marked position for the pivot foot and wrap the strap around the ankle thereby increasing the tension for further firming up the exercise.

The device contemplates an elastic band for circumferentially engaging the ankle of the player with an elastomeric strap secured at a rear portion of the band adjacent the Achilles heel of the player, and anchoring the strap at a position remote from the point where it is attached to the ankle band. Desirably a clip with a ring is secured at the rear portion of the strap so that the same can be attached to a tree, post, or other anchor portion adjacent the ground or floor.

Both the method and the device may be used indoors or outdoors, and can be used in a solo fashion not requiring a helper to retrieve balls, or otherwise assist the player.

In view of the foregoing it is the principal object of the present invention to maximize the kicking capability of a player by providing an exercise which will cause him to repeatedly move the leg and foot through that arc and against those forces which will maximize the velocity and rigidity of the foot when it contacts a ball.

A further object of the present invention is to provide a kicking device which is economical to fabricate, simple to be used, and applicable for both indoors and outdoors usage.

A further object of the present invention is to provide a kicking device and method which can be progressively loaded to increase the severity of the exercise.

Another detailed object of the present invention is to provide a kicking device which will be comfortable while worn, and not interfere with the trajectory of the foot while exercising.

DESCRIPTIVE DRAWINGS

Further objects and advantages of the present invention will become apparent as the following description proceeds, taken in conjunction with the accompanying drawings in which.

Figure 5:
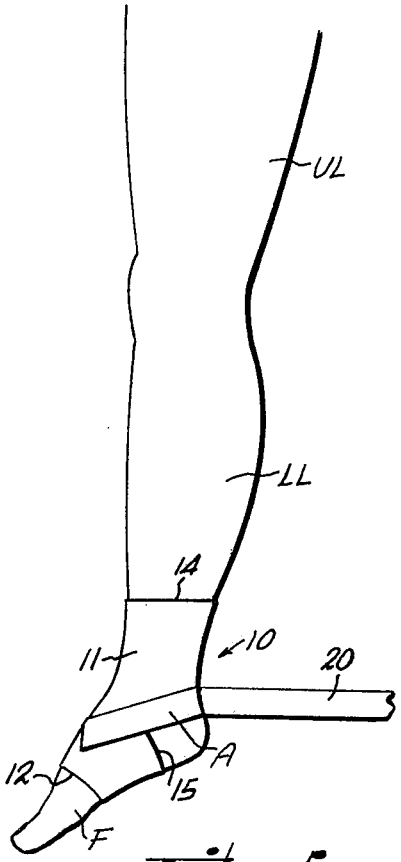
Figure 6:
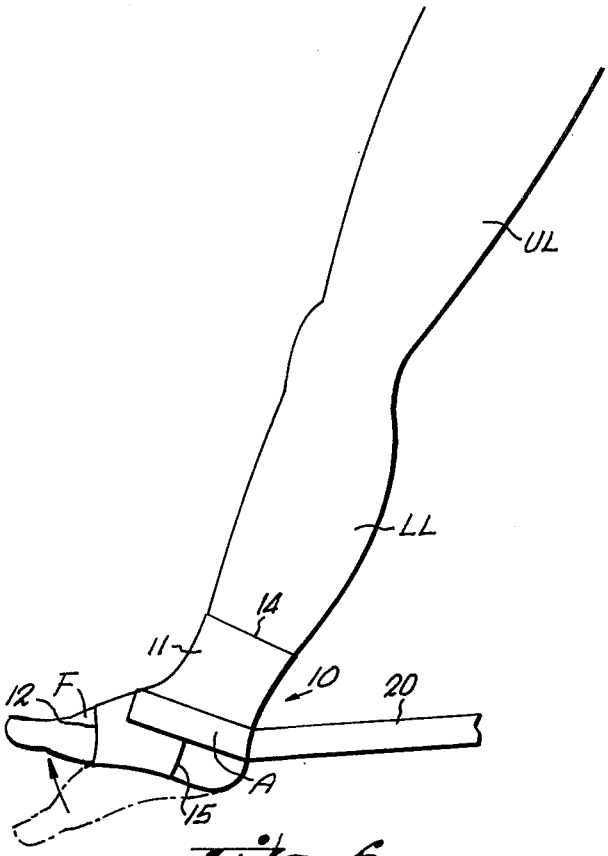
Figure 7:
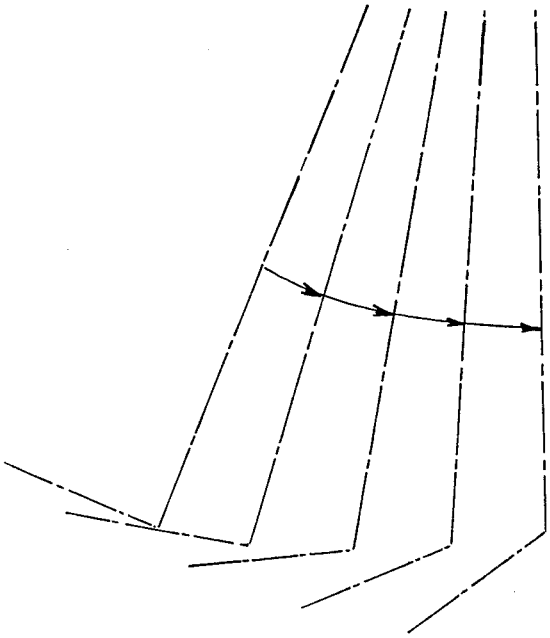

FIGS. 5, 6, and 7 show still a further strengthening exercise with the foot in the downward position such as involved in kicking a soccer ball, with FIG. 7 showing the return of the foot sequentially in phantom lines.

FIG. 8 is a plan view of the device showing the elastic strap broken, and the anchor post in dotted lines.

FIG. 9 is an enlarged view of the right-end anchor portion of the elastic strap with the swivel clip in the extended position.

FIG. 10 is an enlarged transverse sectional view taken through the strap essentially along section line 10—10 of FIG. 8.

THE METHOD

The method of the present invention will be understood by following FIGS. 1–7, and noting that the portions of the body are set forth on those figures with understandable arabic letter designations. As noted in FIG. 1, for example, the foot F and the ankle A are naturally at the lower portion of the lower leg with the tibialis interior muscle at the forward portion of the lower leg being the exercised principal muscle and achieving the perpendicular relationship between the foot F and the lower leg LL. The upper leg UL moves the lower leg LL forward primarily by exercising the quadraceps femoris to bend the leg at the knee joint to straighten up the upper leg UL in its relationship with the lower leg LL. Essentially at the point of contact, the gastrocnemius which is the major portion of the calf exercises the Achilles tendon and works in balancing fashion with the tibialis interior to preserve the rigidity of the foot F in its relationship between the lower leg LL and the ankle A.

Figure 3:
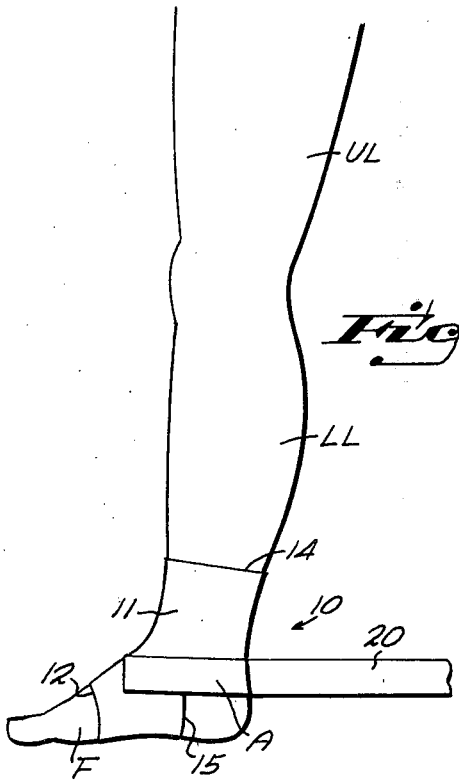
FIG. 3 is a further diagramatic view in the same scale essentially as FIGS. 1 and 2 showing the position of the foot when it is parallel with the ground or floor.
Figure 4:
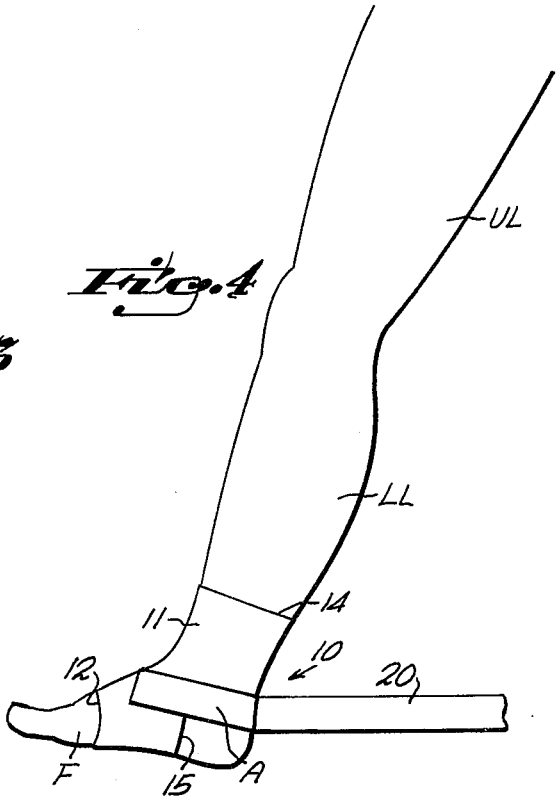
FIG. 4 is illustrative of a further exercise contemplated by the invention where the foot is started with the leg straight and the foot parallel to the floor or ground.

As noted, particularly in FIG. 3 the foot F is substantially perpendicular to the lower leg LL at the point where the foot F is substantially parallel with the ground or floor.

A further exercise contemplated by the method starts with position shown in FIG. 3 and moves the lower leg LL forward with the foot positioned continually in a perpendicular relationship to the lower leg LL.

A further exercise is illustrated in FIG. 5 where the foot F is pointed downwardly from the lower leg LL and as the lower leg LL is moved forwardly the foot F is raised to a position where it becomes substantially perpendicular to the lower leg LL. FIG. 7 shows the phantom lines the return slowly from the position shown in FIGS. 5 and 6.

THE KICKING DEVICE

Figure 1:
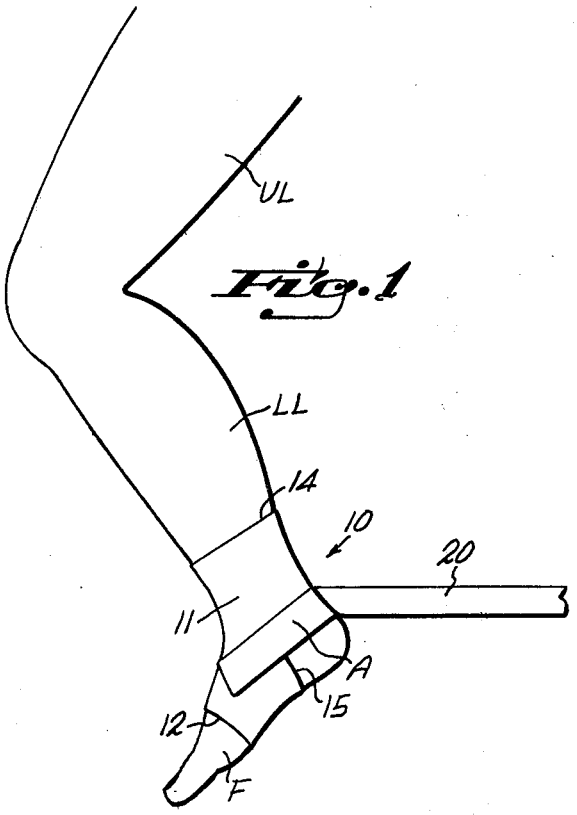
FIG. 1 is a diagramatic view of the kicking leg at the beginning position contemplated by the exercise.
Figure 2:
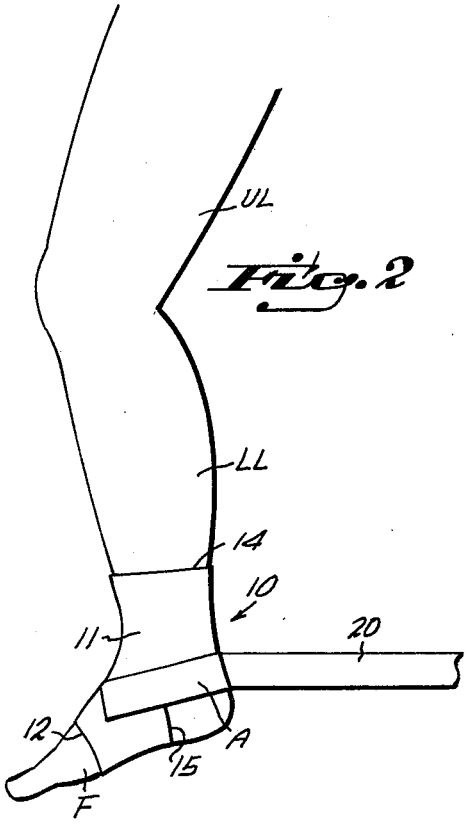
FIG. 2 is a sequential view of the leg after FIG. 1 while the foot is being moved downwardly and forwardly.

The kicking device 10 essentially as shown in FIGS. 8, 9, and 10, is outlined in broad detail on FIG. 1 where it will be seen that the kicking device 10 includes an elastic band 11 with an elastic strap 20 extending rearwardly from it. The kicking device 10 is secured to the foot F of the player at all times while the exercises are being conducted.

In greater detail, it will be seen that the elastic ankle band 11 is a toe opening 12, and ankle opening at the upper portion 14, and a heel opening 15 at the lower portion. The openings are surrounded by a toe seam 16, and ankle seam 18, and a heel seam 19. Such elastic ankle bands 11 are commercially available, one model of which is known by the trademark "The Bike".

The elastic ankle band 11 is secured to an elastic strap 20, and terminates at its remote end and an end loop 21. The ankle band strap portion 22 is shown in FIG. 8, is stitched to the elastic ankle band 11 and secured thereto. At the rear portion of the elastic ankle band 11, the elastic strap 20 is secured by means of an anchor portion 24 which is substantially adjacent to the Achilles tendon of the player. The remote end of the elastic strap 20 has secured to its end loop 21 a swivel clip 25, the securing being through the eye 26 of the swivel clip 25.

As shown particularly by comparison of the illustrations in FIGS. 8 and 9, a ring 30 is provided around the elastic strap 20 to be engaged by means of clip 25 in surrounding engagement to an anchor post 35, the latter being shown in phantom lines in FIG. 8.

Desirably the elastic strap 20 is of a double thickness as shown in FIG. 10, the same being secured by means of double-thickness stitches 28 which, of course, provide the end loop 21 for engaging the swivel clip 25, as well as the means for stitching the ankle band strap forward portion 22 to the elastic ankle band 11.

In review it will be seen that a method has been shown and described for strengthening the kicking leg, and confining the kicker's efforts to maximize the rigidity of the relationship between the player's foot and the leg at the point of ball contact, while applying a restraining force causing the muscles to be exercise. The exercising of the muscles in this fashion will increase the players capability of maximum speed of the travel of the foot at the point of ball contact while training him to also maximize the rigid relationship between the foot and the lower leg.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. An apparatus for improving the skills and strength of a kicker comprising, an elastic sock-like band to engage the kicking foot and ankle of said kicker, said band having portions cut out to expose the toes and heel of said foot and ankle, an elastomeric strap between 1 inch and 2 inches wide, one end portion of said strap sewn to said band so that said strap joins said band in the area covering the Achilles heel of said foot and ankle, and the other end of said strap containing securing means, said strap having a length and stiffness selected so that when said band is engaged by said foot and ankle and when said strap is anchored by employing said securing means to a fixed object in a spaced relationship to said kicker, said kicker can move his kicking foot and ankle through his complete and normal kicking motion while under the restraining force of the stretching of said strap and thereby exercise the muscles that are involved in said kicking motion, said securing means comprising a swivel clip attached to the remote end of said strap together with a ring, slideably surrounding said other other end of said strap, for engagement with said clip, whereby said other end of said strap may be wrapped around a fixed object and said clip engaged with said ring so as to secure said strap to a fixed object.

2. The apparatus defined in claim 1, wherein said strap comprises a second elastomeric strap which is twice the length of said strap and which has been folded in half and said halves sewn together so as to form a double thickness, said strap end portion which is sewn to said band comprises the two end portions of said second strap so that said second strap end portions are sewn to opposing sides of said band in the area covering said ankle, and said strap other end comprises a loop of said second strap thereby engaging said clip's swivel.

* * * * *